US007324763B2

(12) United States Patent
Pytlik

(10) Patent No.: US 7,324,763 B2
(45) Date of Patent: Jan. 29, 2008

(54) APPARATUS, A SYSTEM AND A METHOD FOR TESTING A CARTRIDGE

(75) Inventor: Jacek Pytlik, Arlington Heights, IL (US)

(73) Assignee: T.T.I. International, Inc, Chicago, IL (US)

( * ) Notice: Subject to any disclaimer, the term of this patent is extended or adjusted under 35 U.S.C. 154(b) by 194 days.

(21) Appl. No.: 11/202,002

(22) Filed: Aug. 11, 2005

(65) Prior Publication Data

US 2007/0036564 A1 Feb. 15, 2007

(51) Int. Cl.
*G03G 15/00* (2006.01)
*G03G 21/00* (2006.01)

(52) U.S. Cl. ..... 399/24; 347/19; 399/411; 714/25

(58) Field of Classification Search ..... 399/27, 399/9, 1, 11, 24, 109, 411; 702/108, 182, 702/183; 347/19; 714/25
See application file for complete search history.

(56) References Cited

U.S. PATENT DOCUMENTS 5,357,519 A * 10/1994 Martin et al. ..... 714/25
6,963,936 B2 * 11/2005 Billington et al. ..... 399/411 X
2005/0271401 A1 * 12/2005 Burchette et al. ..... 399/24
2006/0152542 A1 * 7/2006 Dispoto ..... 347/19
2007/0057988 A1 * 3/2007 Nicodem ..... 347/19

OTHER PUBLICATIONS

Tonerhead.com Printer Testmessagers Website downloaded information copyrighted 2004 (index and compatibility HTML), pp. 1-3 and pp. 1.

* cited by examiner

*Primary Examiner*—Sophia S. Chen
(74) *Attorney, Agent, or Firm*—Patents + TMS, P.C.

(57) ABSTRACT

An apparatus, a system and a method are provided for testing a cartridge. The apparatus and/or the system is attached and/or is connected to the printer containing the cartridge via a port of the printer. The apparatus and/or the system communicates with and/or controls the printer. The apparatus and/or the system transmits a signal to the printer. The printer prints one or more pages of paper to test a quality, an effectiveness, a longevity and/or a durability of the toner cartridge. A user inspects and/or reviews one or more pages of paper printed by the cartridge to determine the quality, the effectiveness, the longevity and/or the durability of the toner cartridge.

20 Claims, 3 Drawing Sheets

APPARATUS, A SYSTEM AND A METHOD FOR TESTING A CARTRIDGE

BACKGROUND OF THE INVENTION

The present invention generally relates to an apparatus, a system and a method for testing a cartridge. More specifically, the present invention relates to an apparatus, a system and a method for testing a cartridge, such as, for example, a toner cartridge that may have toner therein. The toner cartridge may be inserted into and/or used in conjunction with, for example, a printer, a telefax machine and/or a photocopier. The apparatus and/or the system may be attached to the printer via a port on the printer. The apparatus and/or the system may have a programmable logical device which may communicate and/or may control the printer and/or the cartridge. The programmable logical device may transmit and/or may communicate a signal to the printer. As a result, the printer and the toner cartridge may pulse and/or may print one or more pages of paper to test the toner cartridge. Further, the printer may perform and/or may execute a yield test. A user may inspect and/or may review one or more printed test pages to determine a quality and/or an effectiveness of the toner cartridge.

It is generally known that a toner cartridge may be filled with and/or have toner within a toner hopper. The toner cartridge may be new, used, emptied, recharged and/or refilled. The toner cartridge may have been assembled incorrectly and/or one or more elements of the toner cartridge may be defective. The toner cartridge may be inserted into the printer for testing of a quality, an effectiveness, a longevity and/or a durability of the toner cartridge.

The printer may have a port, such as, for example, a universal serial bus (USB) port, a centronics port, a line printer terminal (LPT) port or the like. A central processing unit (CPU) or a portable handheld device may be connectable and/or may be attachable to the printer via the port of the printer. The CPU or the portable handheld device may transmit and/or may communicate a signal to the printer. The signal may be in an operating language, such as, for example, a printer command language (PCL), graphics device interface language (GDI), post-script language or the like. The printer may understand and/or may recognize the operating language and the signal may instruct and/or may control the printer. As a result, the printer may test the quality, the effectiveness, the longevity and/or the durability of the toner cartridge by printing one or more test pages of paper. Each of the test pages of paper may have toner printed thereon by the cartridge of the printer.

However, the CPU or the portable handheld device may be configured to only connect to a specific type of port, such as, for example, the USB port of the printer. If the printer does not have a USB port, the CPU or the portable handheld device is not connectable, is not attachable to and/or is not in communication with the printer. Moreover, the printer may only understand, may only recognize and/or may only operate with a specific operating language, such as, for example, the PCL language. If the CPU or the portable handheld device does not send a signal to the printer in the PCL language, the printer may not understand and/or may not recognize the signal from the CPU or the portable handheld device. The printer may not be controlled and/or may not be in communication with the CPU or the portable handheld device. As a result, the printer may not print one or more test pages of paper to test the toner cartridge.

The CPU and/or the portable handheld device may instruct the printer to perform and/or to execute a post test or a yield test in the operational language of the printer. The post test may instruct the printer to print, for example, a single page of paper, three pages of paper, four pages of paper, five-hundred pages of paper, one-thousand pages of paper or five-thousand pages of paper. The yield test may instruct the printer to print, for example, a black page or a colored page of paper, a gray page of paper, a page of paper containing text, a blank page of paper, a five-percent blackened page or a five-percent colored page of paper, a thirty-percent blackened page or a thirty-percent colored page of paper or a page of paper containing more than one color. The pulse test and/or the yield test may test the quality, the effectiveness, the longevity and/or the durability of the toner cartridge. However, the CPU or the portable handheld device may only be able to instruct the printer to perform a single test, such as, for example, the pulse test. As a result, the CPU or the portable handheld device may not be able to instruct the printer to perform both the pulse test and the yield test, and the printer may not test the toner cartridge.

The portable handheld device may operate from electrical power provided by the printer. The CPU may operate from electrical power provided from, for example, an electrical power outlet on a wall. An interruption in the electrical power of the portable handheld device and/or the CPU may cause an interruption in a buffering performed by the printer. As a result, the printer, the CPU and/or the portable handheld device may stop and/or may prevent the printer from completing the post test and/or the yield test. The CPU, the printer and/or the portable handheld device may require disassembly and/or may require rest to be operational after the interruption in the electrical power. As a result, use of the CPU and/or the portable handheld device to test the toner cartridge may be inconvenient, and/or the printer may not complete the test of the toner cartridge.

A need, therefore, exists for an apparatus, a system and a method for testing a cartridge which performs the post test and/or the yield test to test the quality, the effectiveness, the longevity and/or the durability of the toner cartridge. Additionally, a need exists for an apparatus and/or a system for testing a cartridge which may be connectable and/or attachable to the port of the printer. Further, a need exists for an apparatus, a system and a method for testing a cartridge which may transmit, may communicate and/or may send a signal or a transmission to the printer in the operating language of the printer. Still further, a need exists for an apparatus, a system and a method for testing a cartridge which may prevent the interruption of the electrical power provided to the apparatus or the system and/or may prevent the interruption of the buffering performed by the printer.

SUMMARY OF THE INVENTION

The present invention generally relates to an apparatus, a system and a method for testing a toner cartridge. More specifically, the present invention relates to an apparatus, a system and a method for testing a quality, an effectiveness, a longevity and/or a durability of the toner cartridge. The apparatus and/or the system may be connectable and/or may be attachable to a printer containing the toner cartridge via a port of the printer. The apparatus and/or the system may be in communication with and/or in control of the printer via the port on an external surface of the printer. The apparatus and/or the system may have a programmable logic device which may control the printer and/or may transmit a signal to the printer in an operating language of the printer. The signal may instruct the printer to test the toner cartridge by performing and/or by executing a post test and/or a yield test. As a result, the printer may print one or more pages of paper to test the toner cartridge. A user may inspect and/or may review one or more pages printed by the toner cartridge of the printer to determine, the quality, the effectiveness, the longevity and/or the durability of the toner cartridge.

To this end, in an embodiment of the present invention, an apparatus for testing a cartridge in a printer for a defect wherein the printer has a port wherein the defect of the cartridge is identified by a yield test and a post test is provided. The apparatus has a housing having walls defining an interior wherein the housing has an exterior surface. Further, the apparatus has a logical device within the interior of the housing wherein a power source supplies a voltage to the logical device wherein the logical device is programmed to instruct the printer to perform the yield test and the post test. Still further, the apparatus has a user interface located on the exterior surface of the housing wherein the user interface is connected to the logical device wherein the yield test or the post test is selected with the user interface and further wherein the logical device is programmed to produce a signal corresponding to the yield test and the post test. Moreover, the apparatus has a connector on the exterior surface of the housing wherein the connector connects to the logical device wherein the logical device communicates with the printer via the connector and the port of the printer wherein the signal is transmitted from the logical device to the printer via the connector and the port of the printer and further wherein the cartridge prints a page of paper based on the signal from the logical device.

In an embodiment, the power source is a battery located within the interior of the housing or an AC adapter.

In an embodiment, the connector is a cable configured to be insertable into the port of the printer.

In an embodiment, the connector emits infrared light.

In an embodiment, the apparatus has a controller on the exterior surface of the housing to connect the power source and the logical device.

In an embodiment, the apparatus has a light emitting diode on the exterior surface of the housing.

In an embodiment, the user interface has at least one button corresponding to the yield test and the post test.

In another embodiment of the present invention, a system for testing a cartridge in a printer for a defect wherein the printer has a port wherein the printer performs a test to identify the defect of the cartridge wherein a page of paper is printed by the cartridge based on the tests is provided. The system has a housing having walls defining an interior wherein the housing has an exterior surface and a logical device within the interior of the housing wherein the logical device is programmed to instruct the printer to perform the tests. Further, the system has a battery within the interior of the housing wherein the battery provides a voltage to the logical device and a user interface on the exterior surface of the housing wherein the user interface is connected to the logical device wherein one of the tests is selected with the user interface and further wherein a signal corresponding to one of the tests is produced by the logical device. Moreover, the system has a connector on the exterior surface of the housing wherein the connector is connected to the logical device wherein the signal from the logical device is transmitted to the printer via the connector and the port of the printer and further wherein the printer executes one of the tests based on the signal.

In an embodiment, the tests are a yield test and a post test.

In an embodiment, the system has a controller connecting the battery to the logical device.

In an embodiment, the system has a light emitting diode located on the exterior surface of the housing wherein the light emitting diode is controlled by the logical device.

In an embodiment, the connector emits infrared light.

In an embodiment, the connector is configured to be insertable into the port of the printer.

In an embodiment, the battery is rechargeable or replaceable.

In another embodiment of the present invention, a method for testing a cartridge in a printer for a defect wherein the printer has a port wherein the defect of the cartridge is identified by a post test or a yield test is provided. The method has the step of providing a housing having walls defining an interior wherein the housing has an exterior surface wherein a logical device is located within the interior of the housing wherein a user interface is located on the exterior surface of the housing wherein the user interface is connected to the logical device. Further, the method has the steps of providing a voltage to the logical device wherein the voltage is continuous and uninterrupted and programming the logical device to instruct the printer to execute the post test and the yield test. Moreover, the method has the step of transmitting a signal from the logical device to the printer via the port of the printer wherein the signal corresponds to the post test or the yield test and further wherein the signal instructs the printer to execute the post test or the yield test.

In an embodiment, the method has the step of selecting the post test or the yield test with the user interface.

In an embodiment, the method has the step of controlling the voltage to the logical device.

In an embodiment, the method has the step of printing a page of paper based on the signal from the logical device.

In an embodiment, the method has the step of identifying the defect of the cartridge.

In an embodiment, the method has the step of testing the cartridge with the yield test and the post test.

It is, therefore, an advantage of the present invention to provide an apparatus, a system and a method for testing a cartridge.

Another advantage of the present invention is to provide an apparatus, a system and a method for testing a cartridge which may test a quality, an effectiveness, a longevity and/or a durability of the cartridge.

And, another advantage of the present invention is to provide an apparatus, a system and a method for testing a cartridge which may be attachable and/or may be connectable to a printer containing and/or housing the cartridge.

Yet another advantage of the present invention is to provide an apparatus, a system and a method for testing a cartridge which may be configured to be connectable to one or more ports of the printer.

A further advantage of the present invention is to provide an apparatus, a system and a method for testing a cartridge which may transmit, may communicate and/or may send a signal to a printer.

Moreover, an advantage of the present invention is to provide an apparatus, a system and a method for testing a cartridge which may transmit a signal in an operating language of a printer.

And, another advantage of the present invention is to provide an apparatus, a system and a method for testing a cartridge which may instruct a printer to perform and/or to execute a pulse test and/or a yield test to test the cartridge.

Yet another advantage of the present invention is to provide an apparatus, a system and a method for testing a cartridge which may be a portable handheld device.

Another advantage of the present invention is to provide an apparatus, a system and a method for testing a cartridge which may not interrupt a buffering performed by a printer while testing the cartridge.

Yet another advantage of the present invention is to provide an apparatus, a system and a method for testing a cartridge which may prevent an interruption of an electrical power being supplied to the apparatus and/or the system.

A still further advantage of the present invention is to provide an apparatus, a system and a method for testing which may have an independent power source within the apparatus and/or the system.

Moreover, an advantage of the present invention is to provide an apparatus, a system and a method for testing a cartridge which may provide a rechargeable or a replaceable battery within the apparatus and/or the system.

And, another advantage of the present invention is to provide an apparatus, a system and a method for testing a cartridge which may provide one or more light emitting diodes to indicate that a test has been selected.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to an apparatus, a system and a method for testing a cartridge. More specifically, the present invention relates to an apparatus, a system and a method for testing a toner cartridge which has toner in a toner hopper. The apparatus and/or the system may be attached and/or may be connected to the printer containing the toner cartridge via a port on the printer. The apparatus and/or the system may communicate, may instruct and/or may control the printer. The apparatus and/or the system may transmit and/or may communicate a signal and/or a transmission to the printer. As a result, the printer may print one or more pages of paper to test the toner cartridge. A user may inspect and/or may review a consistency of toner on and/or an appearance of one or more pages of paper that may be printed by the toner cartridge to determine a quality, an effectiveness, a longevity and/or a durability of the toner cartridge.

Figure 1:
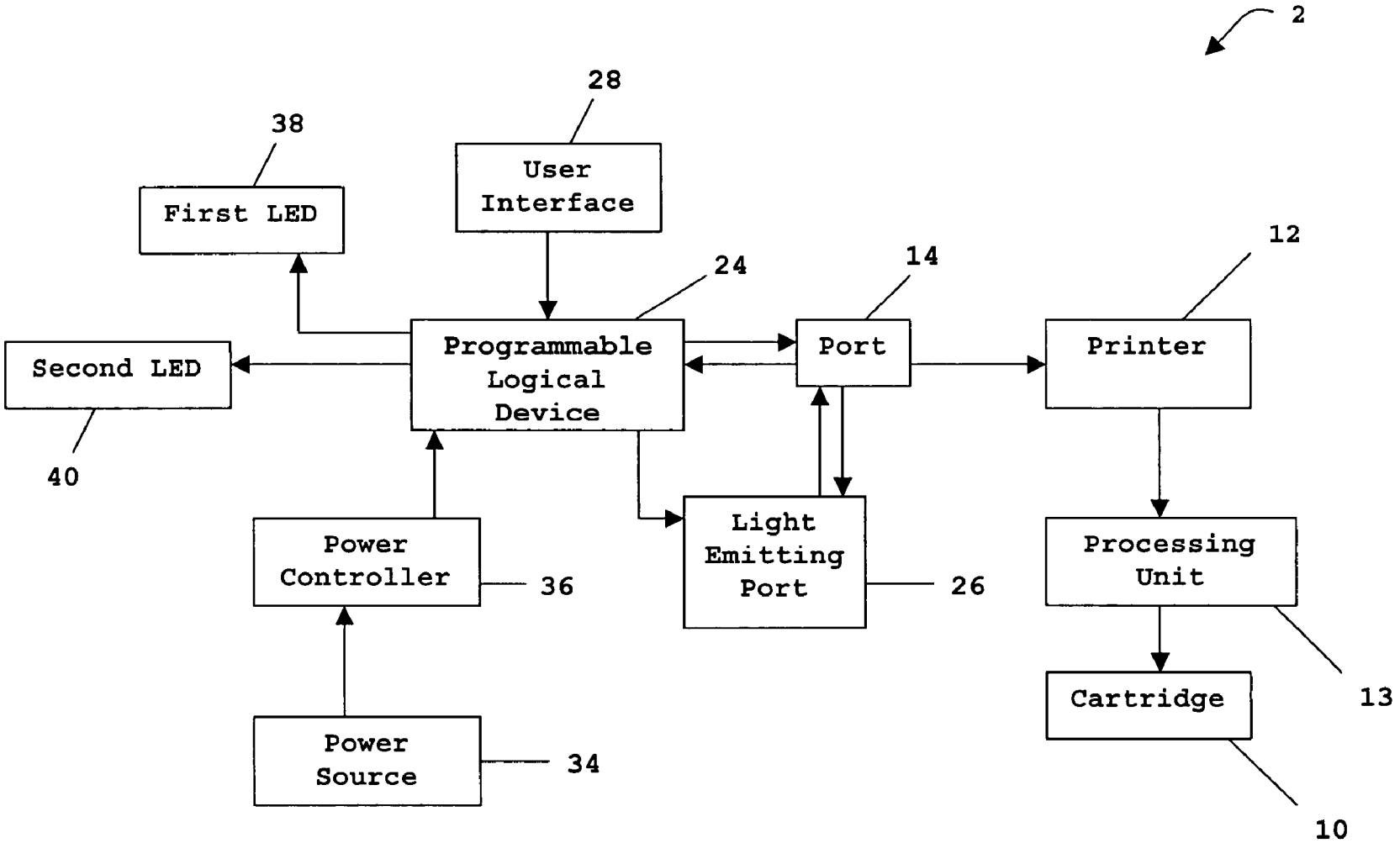
FIG. 1 illustrates a black box diagram of a system for testing a cartridge in an embodiment of the present invention.

Referring now to the drawings wherein like numerals refer to like parts, FIG. 1 illustrates a black box diagram of a system 2 for testing a cartridge 10 in an embodiment of the present invention. The cartridge 10 may be, for example, new, used, emptied, recharged and/or refilled. The cartridge 10 may be a Hewlett Packard (hereinafter "HP") toner cartridge, such as, for example, a HP C4096A cartridge, a HP C4127X cartridge, a HP C8061A cartridge, a HP C8061X cartridge, a HP C2147A cartridge, a HP 8061A cartridge, a HP Q2610A cartridge and/or the like. Alternatively, the cartridge 10 may be a Canon toner cartridge, such as, for example, a Canon L50 cartridge, a Canon FX6 cartridge and/or the like. It should be understood that the cartridge 10 may be any toner cartridge used with, for example, a computer printer, a photocopier, a digital copier, a digital photograph printer, a telefax machine and/or the like.

The cartridge 10 may be filled with and/or may have toner therein. The cartridge 10 may be inserted into, may be used in conjunction with and/or may be housed within a printer 12. The printer 12 may be utilized to test a quality, an effectiveness, a longevity and/or a durability of the cartridge 10. The printer 12 may have a port 14, such as, for example, a universal serial bus port (hereinafter "the USB port"), a centronics port, a line printer terminal port (hereinafter "the LPT port"), an infrared port (hereinafter "the IR port"), a radio frequency port, a wireless port, a wire network port and/or the like. The printer 12 may have a processing unit 13 which may be connected to and/or may be in communication with the port 14. The processing unit 13 may control and/or may instruct the cartridge 10 to print one or more pages of paper to test the cartridge 10. As a result, the printer 12 and the cartridge 10 may print one or more pages of paper. The processing unit 13 of the printer 12 may understand, may recognized, may identify and/or may receive a signal or a transmission in an operating language, such as, for example, a printer command language (hereinafter "the PCL language"), a graphics device interface language (hereinafter "the GDI language"), a post-script language and/or the like. The present invention should not be deemed as limited to the embodiments of a specific port 14 and/or a specific operating language of the processing unit 13.

As illustrated in FIG. 1, an apparatus 20 may have a housing 22 and/or a cable 23 which may extend outward with respect to the housing 22. The apparatus 20 may be, for example, a portable handheld device. The cable 23 may have a connector 25 which is opposite to the apparatus 20. The apparatus 20 may have a programmable logical device 24 contained within the housing 22. The programmable logical device 24 may be connected to the cable 23. The programmable logical device 24 may be, for example, a microcontroller, a microprocessor and/or the like. Alternatively, the housing 22 of the apparatus 20 may have a light emitting port 26 which may emit, for example, an infrared light. The programmable logical device 24 may be connected to, may be in communication with and/or may control the light emitting port 26. The present invention should not be deemed as limited to the embodiments of a specific programmable logical device 24 of the apparatus 20.

Figure 2:
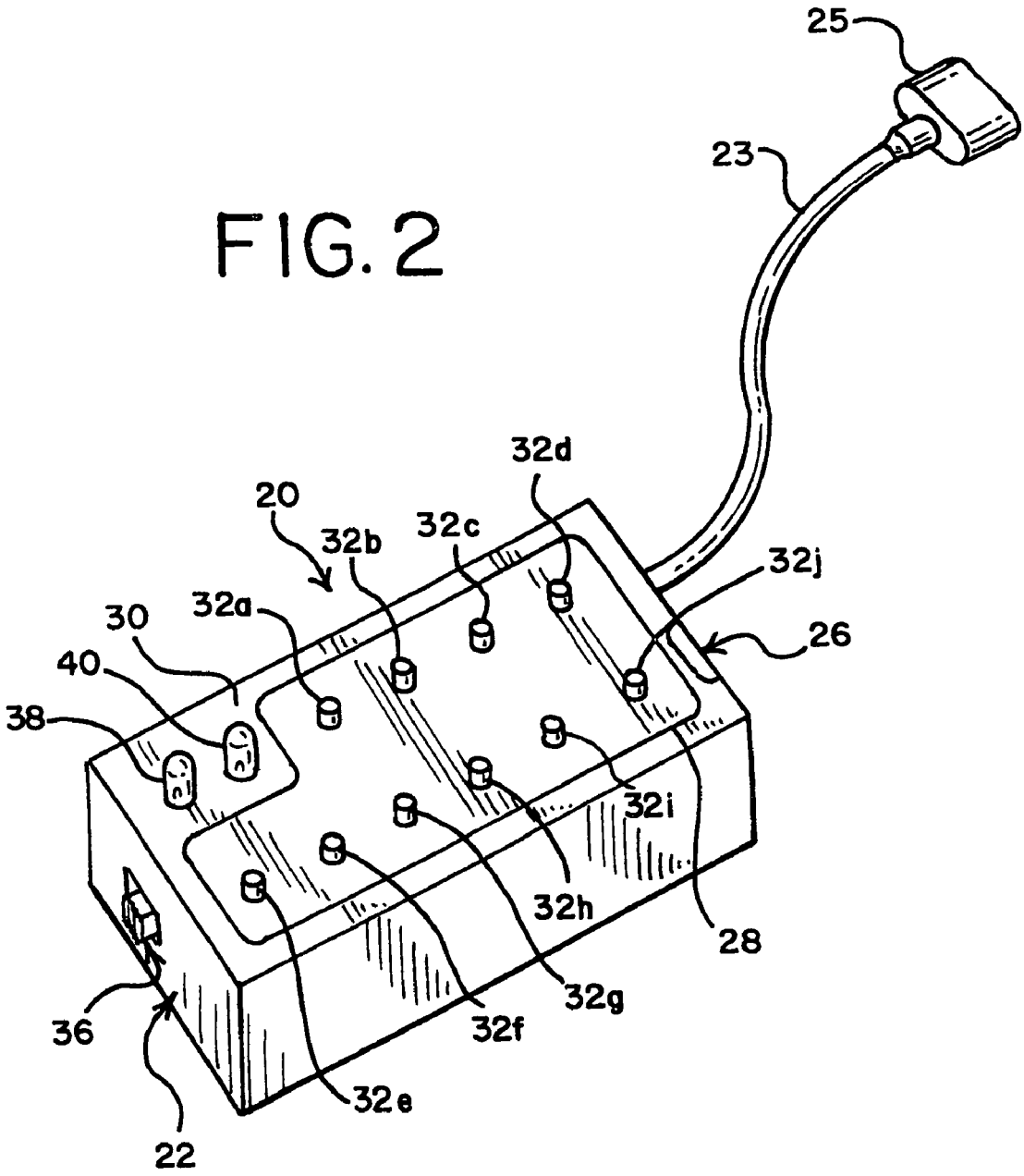
FIG. 2 illustrates a perspective view of an apparatus attachable to a printer in an embodiment of the present invention.

The apparatus 20 may have a user interface 28 on an exterior surface 30 of the housing 22. The user interface 28 may be connected to and/or may be in communication with the programmable logical device 24 within the housing 22. The user interface 28 may control and/or may instruct the programmable logical device 24. The user interface 28 may have, for examples, buttons 32*a*-32*j* extending outward with respect to the housing 22 of the apparatus 20 as shown in FIG. 2. Alternatively, the user interface 28 may be, for example, a touch-screen monitor (not shown in the drawings), one or more switches (not shown in the drawings), one or ore dials (not shown in the drawings) and/or the like. The present invention should not be deemed as limited to the embodiments of a specific user interface 28 of the apparatus 20.

The apparatus 20 may have a power source 34 which may be connected to the programmable logical device 24 as shown in FIG. 1. The power source 34 may be, for example, internal within the housing 22 of the apparatus 20. The power source 34 may provide a voltage to the programmable logical device 24 of the apparatus 20. The voltage may be, for example, 1.5 volts, 9 volts, 110 volts. The programmable logical device 24 may be programmed to have an operational voltage. The voltage provided by the power source 34 may correspond to the operational voltage of the programmable logical device 24. As a result, the programmable logical device 24 may be activated by and/or may be operate with the voltage provide from the power source 34. The power source 34 may be a fuel cell, a solar cell or a battery, such as, for example, a non-rechargeable battery, a rechargeable battery, a replaceable battery, a nickel-metal hydride battery, an alkaline battery and/or the like. Alternatively, the power source 34 may be external and/or may plug into a wall socket (not shown in the drawings) to provide an electrical power supply or voltage to the programmable logical device 24. The present invention should not be deemed as limited to the embodiments of a specific power source 34 of the apparatus 20.

The apparatus 20 may have a power controller 36 which may extend outward with respect to the exterior surface 30 of the housing 22. The power controller 36 may be located between and/or may be in series with the power source 34 and the programmable logical device 24. Further, the power controller 36 may connect the power source 34 to the programmable logical device 24. The power controller 36 may control the voltage supplied to and/or provided to the programmable logical device 24 from the power source 34. The power controller 36 may be, for example, a switch, a button, a dial and/or the like. In an on position of the power controller 36, the power source 34 may provide and/or may supply the voltage to the programmable logical device 24. In an off position of the power controller 36, the power source 34 may be prevented from providing and/or may be prevented from supplying the voltage to the programmable logical device 24 by the power controller 36. The present invention should not be deemed as limited to the embodiments of a specific power controller 36 of the apparatus 20.

The voltage of the power source 34 may be supplied continuously to and/or may be uninterrupted to the programmable logical device 24. As a result, the voltage received by the programmable logical device 24 may be received continuously and/or may be uninterrupted. Further, the power source 34 may prevent an interruption in the voltage provided to the programmable logical device 24. Further, the continuous and uninterrupted voltage from the power source 34 may prevent an interruption in a buffering performed by the processing unit 13 of the printer 12. As a result, the power source 34 may prevent the printer 12 from locking and/or from malfunctioning from an interruption in the buffering performed by the processing unit 13 of the printer 12. The power source 34 may prevent the printer 12 and/or the apparatus 20 from requiring, for example, restarting, resetting and/or reprogramming. As a result, the printer 12 may test the cartridge 10 without interruption and/or to completion. Moreover, the apparatus 20 may be reset and/or may be restarted by disconnecting the power source 34 from the programmable logical device 24 and/or deactivating the apparatus 20 with the power controller 36.

As illustrated in FIG. 2, the apparatus 20 may have a first light emitting diode (hereinafter "LED") 38 and/or a second LED 40. The first LED 38 and/or the second LED 40 may extend outward with respect to the exterior surface 30 of the apparatus 20. The programmable logical device 24 may be programmed to activate or deactivate the first LED 38 and/or the second LED 40. The first LED 38 and/or the second LED 40 may be connected to and/or may be controlled by the programmable logical device 24 and/or the user interface 28. The programmable logical device 24 may transmit and/or may communicate a signal and/or a voltage to the first LED 38 and/or the second LED 40. The signal and/or the voltage may activate and/or may illuminate the first LED 38 and/or the second LED 40. In an activated state, the first LED 38 and/or the second LED 40 may emit light outward with respect to the housing 22 of the apparatus 20.

The connector 25 of the cable 23 may be configured to be insertable into and/or to be connectable to the port 14 of the printer 12. The apparatus 20 may be attached to, may be connected to and/or may be coupled with the printer 12 via the connector 25 of the cable 23 and/or the port 14 of the printer 12. The programmable logical device 24 may be programmed to communicate with and/or to control the printer 12. As a result, the programmable logical device 24 of the apparatus 20 may be connected, may be in communication with and/or may be coupled to the processing unit 13 of the printer 12. Alternatively, the apparatus 20 may be position adjacent to the port 14 of the printer 12. The light emitting port 26 of the apparatus 20 may be within a range of the port 14 of the printer 12. The light emitting port 26 may transmit a signal and/or a transmission to the port 14 of the printer 12. As a result, the programmable logical unit 24 of the apparatus 20 may be connected to and/or may be in communication with the processing unit 13 of the printer 12.

The user (not shown in the drawings) may activate or deactivate the apparatus 20 with the power controller 36. Further, the user may utilize the user interface 28 and/or one or more of the buttons 32*a*-32*j* to operate and/or to activate the apparatus 20. As a result, the user may control, may communicate with and/or may instruct the programmable logical device 24 with the user interface 28 and/or one or more of the buttons 32*a*-32*j*. The user may select and/or may press one or more of the buttons 32*a*-32*j* on the external surface 30 of the housing 22 of the apparatus 20. Each of the buttons 32*a*-32*j* may correspond to a command for testing the cartridge 10 within the printer 12. The programmable logical device 24 may be programmed with the commands corresponding to each of the buttons 32*a*-32*j* and/or with tests for testing the cartridge 10 of the printer 12. Each command may correspond to one of the tests, such as, for example, a post test and/or a yield test for testing the cartridge 10. Pressing one of the buttons 32*a*-32*j* may send and/or may transmit a signal and/or a transmission corresponding to the command to the programmable logical device 24. The programmable logical device 24 may understand, may identify and/or may recognize the command, the signal and/or the transmission. As a result, the programmable logical device 24 may transmit, may communicate and/or may send a signal and/or a transmission to the processing unit 13 of the printer 12 via the port 14 of the printer 12. The signal and/or the transmission from the programmable logical device 24 may instruct, may control and/or may signal the processing unit 13 to test the cartridge 10 with the post test and/or the yield test.

Before printing a page of paper, the processing unit 13 may transmit a signal or a transmission to the cartridge 10. The signal may cause a pair of motors (not shown in the drawings) of the cartridge 10 to move and/or to pulse before the cartridge 10 may print the page of paper. The moving and/or the pulsing of the cartridge aligns the pair of motors prior to the cartridge 10 printing the page of paper. After the pair of motors are aligned, the processing unit 13 may buffer and/or may transmit printing instructions to the cartridge 10, and the cartridge 10 may print one or more pages of paper.

A pulsing during the yield test may determine, may indicate and/or may affect the longevity of the cartridge 10.

The command selected by the user with one of the buttons 32*a*-32*d* may correspond to a pulse test for testing the cartridge 10 of the printer 12. The programmable logical device 24 may recognize the pulse test selected by the user and/or may communicate and/or may transmit a signal corresponding to the pulse test to the processing unit 13 of the printer 12. The pulse test may instruct the processing unit 13 to pulse the cartridge 10 and/or to subsequently buffer and/or to provide printing instructions to the cartridge 10. As a result of the pulse test, the cartridge 10 may be pulsed and may print one or more test pages of paper.

For example, the button 32*a* may correspond to a command for a one-page pulse test. The button 32*a* may be selected for the one-page pulse test. As a result, a command for the one-page pulse test may be transmitted to the programmable logical device 24 of the apparatus 20. The programmable logical device 24 may identify and/or may recognize the command. The programmable logical device 24 may transmit and/or may send a signal to the processing unit 13 of the printer 12 via the cable 23 or the light emitting port 14 of the apparatus 20 and the port 14 of the printer 12. The signal may instruct the processing unit 13 to perform and/or to execute the one-page pulse test. As a result, the processing unit 13 may pulse the cartridge 10 to align the pair of motors of the cartridge 10, and the cartridge 10 may print a test page of paper.

The buttons 32*b*, 32*c* and 32*d* may correspond to, for example, commands for a three-page pulse test, a five hundred page straight test and a one thousand page straight test, respectively. One of the buttons 32*b*, 32*c* or 32*d* may be pressed and/or may be selected by the user. As a result, the command for the three-page pulse test, the five hundred page pulse test or the one thousand page pulse test may be transmitted to, may be recognized by and/or may be identified by the programmable logical device 24 of the apparatus 20. The programmable logical device 24 may transmit and/or may communicate a signal for the three-page pulse test, the five hundred page pulse test or the one thousand page pulse test to the processing unit 13 of the printer 12. As a result, the processing unit 13 may pulse the cartridge 10 and the cartridge 10 may print three test pages, five hundred test pages or one thousand test pages of paper, respectively. It should be understood that the buttons 32*a*-32*d* may instruct the processing unit 13 and/or the cartridge 10 of the printer 12 to perform and/or to execute any pulse test and/or any straight test that are generally known and may be implemented by one having ordinary skill in the art.

After one of the buttons 32*a*-32*d* have been pressed, the programmable logical device 24 may transmit a signal and/or a voltage to the first LED 38 or the second LED 40, respectively. The signal and/or the voltage from the programmable logical device 24 may activate the first LED 38 or the second LED 40. The first LED 38 and/or the second LED 40 may emit light to indicate that the test corresponding to one of the buttons 32*a*-32*d* may have been selected and/or may be executed by the printer 12. It should be understood that programmable logical device 24 may activate the first LED 38 and/or the second LED 40 to indicate that any pulse test and/or any straight test may have been selected and/or may be executed that are generally known and may be implemented by one having ordinary skill in the art.

Each of the buttons 32*e*-32*j* may correspond to a command for a yield test. The programmable logical device 24 may be programmed with commands for the yield tests corresponding to each of the buttons 32*e*-32*j*. Pressing one of the buttons 32*e*-32*j* may send, may communicate and/or may transmit a signal corresponding to the command to the programmable logical device 24. The command and/or the signal may be recognized, may be identified and/or may be understood by the programmable logical device 24. The programmable logical device 24 may transmit, may communicate and/or may send a signal to the processing unit 13 of the printer 12 via the cable 23 or the light emitting port 26 of the apparatus 20 and/or the port 14 of the printer 12. The processing unit 13 of the printer 12 may recognize, may identify and/or may understand the signal received from the programmable logical device 24. The signal may instruct the processing unit 13 and the cartridge 10 to perform and/or to execute the yield test which corresponds to the signal from the programmable logical device 24 and/or the command from one of the buttons 32*e*-32*j*.

The yield test may instruct the printer 12 to print one or more test pages of paper. The test pages of paper may be, for example, one or more black test pages of paper, one or more colored test pages of paper, one or more gray test pages of paper, one or more test pages of paper containing text and/or one or more blank test pages of paper. Further, the test pages may be, for example, one or more three-percent blackened test pages of paper, one or more three-percent single color test pages of paper, one or more five-percent blackened test pages of paper and/or one or more five-percent single color test pages of paper. Moreover, the test pages may be one or more thirty-percent blackened test pages of paper, one or more thirty-percent single color test pages of paper, one or more multicolor test pages of paper and/or the like.

For example, the user may press the button 32*j* which may correspond to a command for a gray page test. As a result, the button 32*j* may send, may communicate and/or may transmit a signal to the programmable logical device 24. The programmable logical device 24 may understand, may recognize and/or may identify the signal to correspond to the gray page test. As set forth above for the pulse test, the programmable logical device 24 may transmit, may communicate and/or may send a signal to the processing unit 13 of the printer 12. The processing unit 13 may understand, may recognize and/or may identify the signal corresponding to the gray page test. The cartridge 10 and the processing unit 13 may execute the gray page test. As a result, the printer 12 may print one or more gray test pages which may have a shading between a blank page and a page covered with toner.

The buttons 32*e*-32*i* may correspond to a five-percent toner yield test, a three-percent toner yield test, an all character yield test, a blank yield test and a black yield test, respectively. The toner may be, for example, black toner, toner of a single color and/or toners of more than one color. Similar to that set forth above for the gray page test, pressing or selecting the button 32*e* may instruct the printer 12 to print one or more test pages which may have five percent of the page or pages covered with toner. Further, pressing or selecting the button 32*f* may instruct the printer 12 to print one or more test pages which may have three percent of the page or pages covered with toner. Still further, pressing or selecting the button 32*g* may instruct the printer 12 to print one or more test pages which may have all standard characters of a computer keyboard (not shown in the drawings) covering the page or pages. Moreover, pressing or selecting the button 32*h* may instruct the printer 12 to print one or more test pages which may have no toner thereon. Furthermore, pressing or selecting the button 32*i* may instruct the printer 12 to print one or more test pages which may be covered with toner. The user may select the number of test pages printed by the printer 12 during the yield test by selecting and/or by pressing one of the buttons 32*a*-32*d*. Selecting and/or pressing one of the buttons 32*e*-32*j* and the button 32*a* may instruct the printer 12 to execute and/or to perform one of the yield tests and print a single test page of the yield test. Further, selecting and/or pressing one of the buttons 32*e*-32*j* and the button 32*b* may instruct the printer 12 to execute and/or to perform one of the yield tests and print three test pages of the yield test. Still further, selecting and/or pressing one of the buttons 32*e*-32 *j* and the button 32*c* may instruct the printer 12 to execute and/or to perform one of the yield tests and print five hundred test pages of the yield test. Moreover, selecting and/or pressing one of the buttons 32*e*-32*j* and the button 32*d* may instruct the printer 12 to execute and/or to perform one of the yield tests and print one thousand test pages of the yield test.

Figure 3:
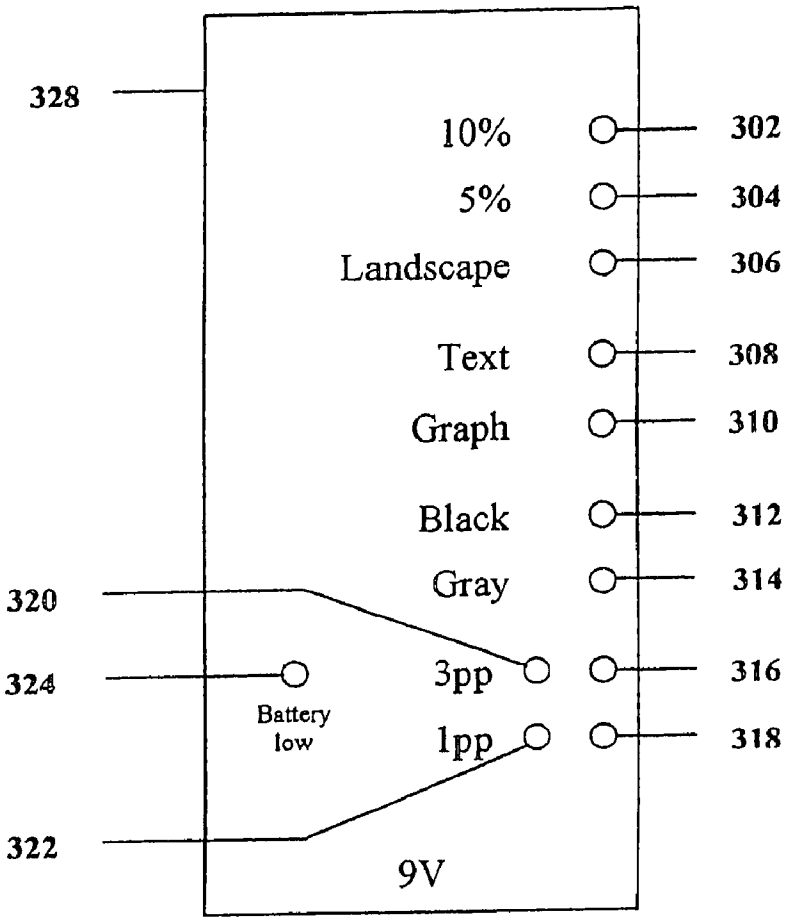
FIG. 3 illustrates a top plan view of a user interface of an apparatus in an embodiment of the present invention.

FIG. 3 illustrates a user interface 328 in another embodiment of the present invention. The user interface 328 may have buttons 302, 304, 306, 308, 310, 312, 314, 316, 318 which may be depressed to test the cartridge 10. Further, the user interface 328 may have a first light emitting diode (hereinafter "LED") 320, a second LED 322 and/or a third LED 324. The programmable logical device 24 may be programmed to activate or deactivate the first LED 320, the second LED 322 and/or the third LED 324. The first LED 320, the second LED 322 and/or the third LED 324 may be connected to and/or may be controlled by the programmable logical device 24 and/or the user interface 328. The programmable logical device 24 may transmit and/or may communicate a signal and/or a voltage to the first LED 320, the second LED 322 and/or the third LED 324. The signal and/or the voltage may activate and/or may illuminate the first LED 320, the second LED 322 and/or the third LED 324. In an activated state, the first LED 320, the second LED 322 and/or the third LED 324 may emit light.

The user may utilize the user interface 328 to activate the apparatus 20. As a result, the user may control, may communicate with and/or may instruct the programmable logical device 24 with the user interface 328 and/or one or more of the buttons 302, 304, 306, 308, 310, 312, 314, 316, 318. Each of the buttons 302, 304, 306, 308, 310, 312, 314, 316, 318 may correspond to a command for testing the cartridge 10 within the printer 12. The programmable logical device 24 may be programmed with the commands corresponding to each of the buttons 302, 304, 306, 308, 310, 312, 314, 316, 318 and/or with tests for testing the cartridge 10 of the printer 12. Each command may correspond to one of the tests, such as, for example, a pulse test and/or a yield test for testing the cartridge 10. Pressing one of the buttons 302, 304, 306, 308, 310, 312, 314, 316, 318 may send and/or may transmit a signal and/or a transmission corresponding to the command to the programmable logical device 24. The programmable logical device 24 may understand, may identify and/or may recognize the command, the signal and/or the transmission. As a result, the programmable logical device 24 may transmit, may communicate and/or may send a signal and/or a transmission to the processing unit 13 of the printer 12 via the port 14 of the printer 12. The signal and/or the transmission from the programmable logical device 24 may instruct, may control and/or may signal the processing unit 13 to test the cartridge 10 with the pulse test and/or the yield test. The command selected by the user with one of the buttons 302, 304, 306, 308, 310, 312, 314, 316, 318 may correspond to a pulse test for testing the cartridge 10 of the printer 12. The programmable logical device 24 may recognize the pulse test selected by the user and/or may communicate and/or may transmit a signal corresponding to the pulse test to the processing unit 13 of the printer 12. The pulse test may instruct the processing unit 13 to pulse the cartridge 10 and/or to subsequently buffer and/or to provide printing instructions to the cartridge 10. As a result of the pulse test, the cartridge 10 may be pulsed and may print one or more test pages of paper. For example, the buttons 302, 304, 306 may correspond to a command for a ten percent yield test, a five percent yield test and/or a landscape test, respectively. The buttons 308, 310 may correspond to a command for a text print test and/or a graph print test, respectively. The buttons 312, 314 may correspond to a command for a black print test and/or a gray page test, respectively. The buttons 316, 318 may correspond to a command for a three-page pulse test and/or a one-page pulse test, respectively. The programmable logical device 24 may identify and/or may recognize the command. The programmable logical device 24 may transmit and/or may send a signal to the processing unit 13 of the printer 12 via the cable 23 or the light emitting port 14 of the apparatus 20 and the port 14 of the printer 12. The signal may instruct the processing unit 13 to perform and/or to execute the one-page pulse test. It should be understood that the buttons 302, 304, 306, 308, 310, 312, 314, 316, 318 may instruct the processing unit 13 and/or the cartridge 10 of the printer 12 to perform and/or to execute any pulse test and/or any straight test that are generally known and may be implemented by one having ordinary skill in the art.

The first LED 320 and/or the second LED 322 may correspond to and/or may be controlled be the buttons 316, 318, respectively. The buttons 316, 318 may be depressed to select a command for a test, such as, for example, the three-page pulse test and/or the one-page pulse test, respectively. The programmable logical device 24 may identify the command and/or may activate the first LED 320 and/or the second LED 322 to indicate that the buttons 316, 318, respectively, were depressed. As a result, the first LED 320 and/or the second LED 322 may emit light to indicate that the buttons 316, 318 were selected. The third LED 324 may be controlled and/or may be in communication with the power source 34. The programmable logical device 24 may determine that the power source 34 may have a low electrical charge. The programable logical device 24 may activate the third LED 324 to indicate that the electrical power stored in the power source may be low. As a result, the third Led 324 may emit light to indicate that the electrical power stored in the power source may be low. It should be understood that programmable logical device 24 may activate the first LED 320 and/or the second LED 322 to indicate that any pulse test and/or any straight test may have been selected and/or may be executed that are generally known and may be implemented by one having ordinary skill in the art.

The user may review one or more of the test pages printed by the printer 12 during one of the post tests and/or one of the yield tests. The user may examine and/or may review an appearance of one or more of the test pages printed by the cartridge 10. A defect in the appearance of one or more of the test pages may indicate that the cartridge 10 is defective and/or has been damaged from the pulsing of the cartridge 10. Further, the user may examine and/or may review a consistency of toner on one or more of the test pages. An inconsistency of the toner of one or more test pages may indicate that the cartridge 10 may be defective and/or may have been damaged by the pulsing of the cartridge 10. The user may discard and/or may destroy the cartridge 10 which may be defective and/or damaged from the pulsing of the cartridge 10. Alternatively, the user may correct the defect of the cartridge 10 and/or may repair the damage to the cartridge 10.

The apparatus 20 and/or the system 2 may test the cartridge 10 having toner therein for defects. The apparatus 20 and/or the system 2 may be attached and/or may be connected to the printer 12 containing the cartridge 10 via the port 14 of the printer 12. The apparatus 20 and/or the system 2 may communicate, may instruct and/or may control the printer 12. The apparatus 20 and/or the system 2 may transmit, may send and/or may communicate a signal and/or a transmission to the printer 12 via the port 14. The printer 12 may print one or more test pages of paper to test the quality, the effectiveness, the longevity and/or the durability of the cartridge 10. A user may inspect and/or may review a consistency of the toner on and/or the appearance of one or more of the test pages to determine whether the cartridge 10 is defective and/or has been damaged by pulsing from the printer 12.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for testing a cartridge in a printer for a defect wherein the printer has a port wherein the defect of the cartridge is identified by a yield test and a post test, the apparatus comprising:

a housing having walls defining an interior wherein the housing has an exterior surface;

a logical device within the interior of the housing wherein a power source supplies a voltage to the logical device wherein the logical device is programmed to instruct the printer to perform the yield test and the post test;

a user interface located on the exterior surface of the housing wherein the user interface is connected to the logical device wherein the yield test or the post test is selected with the user interface and further wherein the logical device is programmed to produce a signal corresponding to the yield test and the post test;

a connector on the exterior surface of the housing wherein the connector connects to the logical device wherein the logical device communicates with the printer via the connector and the port of the printer wherein the signal is transmitted from the logical device to the printer via the connector and the port of the printer and further wherein the cartridge prints a page of paper based on the signal from the logical device wherein the connector is a light emitting port that emits infrared light that transmits the signal from the logical device to the port of the printer; and a first light emitting diode on the exterior surface of the housing wherein the first light emitting diode emits light if the signal is transmitted from the logical device to the printer via the connector and the port of the printer.

2. The apparatus of claim 1 wherein the power source is a battery located within the interior of the housing or an AC adapter.

3. The apparatus of claim 1 further comprising:

a cable attached to the exterior surface of the housing wherein the cable is configured to be insertable into the port of the printer.

4. The apparatus of claim 1 further comprising:

a controller on the exterior surface of the housing that controls voltage supplied to the logical device from the power source.

5. The apparatus of claim 1 further comprising:

a controller on the exterior surface of the housing to connect the power source and the logical device.

6. The apparatus of claim 1 further comprising:

a second light emitting diode on the exterior surface of the housing wherein the second light emitting diode emits light if the test has been executed by the printer.

7. The apparatus of claim 1 wherein the user interface has at least one button corresponding to the yield test and the post test.

8. A system for testing a cartridge in a printer for a defect wherein the printer has a port wherein the printer performs a test to identify the defect of the cartridge wherein a page of paper is printed by the cartridge based on the test, the system comprising:

a housing having walls defining an interior wherein the housing has an exterior surface;

a logical device within the interior of the housing wherein the logical device is programmed to instruct the printer to perform the tests;

a battery within the interior of the housing wherein the battery provides a voltage to the logical device;

a user interface on the exterior surface of the housing wherein the user interface is connected to the logical device wherein one of the tests is selected with the user interface and further wherein a signal corresponding to one of the tests is produced by the logical device;

a connector on the exterior surface of the housing wherein the connector is connected to the logical device wherein the signal from the logical device is transmitted to the printer via the connector and the port of the printer and further wherein the printer executes one of the tests based on the signal wherein the connector is a light emitting port that emits infrared light that transmits the signal from the logical device to the port of the printer; and a first light emitting diode on the exterior surface of the housing wherein the first light emitting diode emits light if the signal is transmitted from the logical device to the printer via the connector and the port of the printer.

9. The system of claim 8 wherein the tests are a yield test and a post test.

10. The system of claim 8 further comprising:

a controller connecting the battery to the logical device.

11. The system of claim 8 further comprising:

a second light emitting diode located on the exterior surface of the housing wherein the light emitting diode is controlled by the logical device wherein the second light emitting diode emits light if the test has been executed by the printer.

12. The system of claim 8 further comprising:

a controller on the exterior surface of the housing that controls voltage supplied to the logical device from the power source.

13. The system of claim 8 further comprising:

a cable attached to the exterior surface of the housing wherein the cable is configured to be insertable into the port of the printer.

14. The system of claim 8 wherein the battery is rechargeable or replaceable.

15. A method for testing a cartridge in a printer for a defect wherein the printer has a port wherein the defect of the cartridge is identified by a post test or a yield test, the method comprising the steps of:

providing a housing having walls defining an interior wherein the housing has an exterior surface wherein a logical device is located within the interior of the housing wherein a user interface is located on the exterior surface of the housing wherein the user interface is connected to the logical device;

providing a voltage to the logical device wherein the voltage is continuous and uninterrupted;

programming the logical device to instruct the printer to execute the post test and the yield test;

transmitting a signal from the logical device to the printer via the port of the printer wherein the signal corresponds to the post test or the yield test and further wherein the signal instructs the printer to execute the post test or the yield test; and indicating that the signal has been transmitted to the printer.

16. The method of claim 15 further comprising the step of:

selecting the post test or the yield test with the user interface.

17. The method of claim 15 further comprising the step of:

controlling the voltage to the logical device.

18. The method of claim 15 further comprising the step of:

printing a page of paper based on the signal from the logical device.

19. The method of claim 15 further comprising the step of:

identifying the defect of the cartridge.

20. The method of claim 15 further comprising the step of:

testing the cartridge with the yield test and the post test.

* * * * *